US008186197B2

(12) United States Patent
Walle

(10) Patent No.: US 8,186,197 B2
(45) Date of Patent: May 29, 2012

(54) ADJUSTABLE FLANGE FORMING APPARATUS

(75) Inventor: David Walle, Saint Peters, MO (US)

(73) Assignee: Mestek Machinery, Inc., Westfield, MA (US)

( * ) Notice: Subject to any disclaimer, the term of this patent is extended or adjusted under 35 U.S.C. 154(b) by 937 days.

(21) Appl. No.: 11/940,442

(22) Filed: Nov. 15, 2007

(65) Prior Publication Data

US 2008/0115550 A1 May 22, 2008

Related U.S. Application Data

(60) Provisional application No. 60/866,156, filed on Nov. 16, 2006.

(51) Int. Cl.
*B21D 5/08* (2006.01)
*B21B 31/16* (2006.01)

(52) U.S. Cl. ..... 72/181; 72/176; 72/247

(58) Field of Classification Search ..... 72/176, 72/179, 180–182, 247, 446, 447, 454
See application file for complete search history.

(56) References Cited

U.S. PATENT DOCUMENTS

| | | | | |
|---|---|---|---|---|
| 3,815,388 | A | 6/1974 | Nichol et al. | |
| 3,815,398 | A | 6/1974 | McClain | |
| 3,903,723 | A | 9/1975 | Colbath | |
| 4,466,641 | A | 8/1984 | Hielman et al. | |
| 5,163,311 | A | 11/1992 | McClain et al. | |
| 5,722,278 | A | 3/1998 | Horino et al. | |
| 6,148,654 | A | 11/2000 | Jensen et al. | |
| 6,216,514 | B1 | 4/2001 | Bradbury et al. | |
| 6,547,287 | B1 | 4/2003 | Shah et al. | |
| 2005/0252265 | A1 * | 11/2005 | McDonald | 72/181 |

FOREIGN PATENT DOCUMENTS

| | | |
|---|---|---|
| GB | 1498670 | 1/1978 |
| WO | WO 84/01911 | 5/1984 |
| WO | WO 02/43886 | 6/2002 |

* cited by examiner

*Primary Examiner* — Debra Sullivan
(74) *Attorney, Agent, or Firm* — McCormick, Paulding & Huber LLP

(57) ABSTRACT

A flange-forming apparatus allows a user to automatically adjust the device's roll forming stations, concurrently together, for changing the height of a flange formed into a metal web by the roll forming stations, e.g., for ductwork. The height is adjustable within an infinite range between set maximum and minimum limits. Each roll forming station includes upper and lower roll forming pairs, which cooperate for forming the flange or portion thereof. Each roll forming pair includes a first roll forming portion, and a second, coaxial roll forming portion that is axially moveable towards and away from the first roll forming portion. (The portions are in effect a laterally split roll forming die.) The second roll forming portions are rotatably supported on a plate-like adjustment linkage assembly, which can be shifted, using an array of motor driven screw members, towards or away from the first roll forming portions.

20 Claims, 9 Drawing Sheets

ADJUSTABLE FLANGE FORMING APPARATUS

CROSS REFERENCE TO RELATED APPLICATIONS

This application claims the benefit of U.S. Provisional Application Ser. No. 60/866,156, filed Nov. 16, 2006, incorporated by reference herein in its entirety.

FIELD OF THE INVENTION

The present invention relates to machine tools and, more particularly, to devices for forming flanges in metal ductwork.

BACKGROUND OF THE INVENTION

With reference to FIGS. 1, 1A, and 1B, for connecting longitudinally adjacent, end-on-end sections 20*a*, 20*b* of rectangular, metal ductwork together, each end of the duct section 20*a*, 20*b* is typically provided with an integral transverse flange 22, such as a TDC® flange or a TDF® flange. Transverse flanges can be configured in different manners. In the example shown in FIGS. 1A and 1B, the flange 22 includes an upturned portion 24 extending perpendicularly outwards from the duct wall 26. A rearwardly bent portion 28, integral with the upturned portion 24 and lying generally perpendicular thereto, extends rearwards opposite the duct wall. A forewardly extending return portion 30 is integrally connected to the rearwardly bent portion 28, and is connected thereto by way of a rounded bead portion 32. A channel 34 is formed between the bead 32 and the upturned portion 24, and a similar channel 36 is formed in the duct wall opposite the channel 34, between the upturned portion 24 and the duct wall 26. (The channels 34, 36 accommodate a corner-type connector, not shown.) Further information about transverse flanges can be found, for example, in U.S. Pat. No. 4,466,641, dated Aug. 21, 1984, and in U.S. Pat. No. 6,547,287, dated Oct. 11, 2001, which also describe how the flanges are used to connect sections of duct together.

Instead of cutting, assembling, and installing a separate flange onto the ductwork, transverse flanges are typically roll formed directly onto the duct. For doing so, the edge of the metal sheeting used to form the duct is subjected to one or more roll forming operations that bend or otherwise manipulate the metal sheeting according to the desired flange configuration. The roll forming operations are carried out using a roll-forming apparatus or machine. The roll-forming machine includes a number of successively arrayed stations. As the metal sheet is passed through the roll-forming machine, each station manipulates the metal sheet according to its particular configuration.

Because roll forming operations involve the manipulation of metal sheeting, a roll-forming machine must be heavy duty, robust, and resistant to the misalignment and maladjustment of its parts. Accordingly, roll-forming machines are typically configured to produce only one type or configuration of flange, with set dimensions. If another type of flange is to be produced, or the same type of flange but with different dimensions, the machine must be manually re-tooled. For doing so, for each station, various plates and other outer portions are removed to access the station. Then, various rings, retainers, and other connectors are removed to access the tool, the tool is replaced with a new tool, and the retaining and cover portions are reattached to the device. Some roll-forming machines have been proposed for allowing the roll forming stations to be adjusted in a limited manner, but these have been based on air cylinders or hydraulic cylinders, which lack the positive location required for accurate, repetitive roll-forming operations in an industrial setting.

SUMMARY OF THE INVENTION

It is an object of the present invention to provide a flange-forming device or apparatus that allows a user to automatically adjust the device's roll forming stations, concurrently together, as relating to one or more operational characteristics of the stations for producing a flange in a sheet or web of metal or other material. For example, in one embodiment, the roll forming stations are concurrently adjustable for changing a height of the flange within an infinite range between set maximum and minimum limits.

To achieve this and other objects, an embodiment of the present invention relates to a flange forming apparatus that includes a support frame, and a number of roll forming stations carried on the support frame for forming a flange in a sheet or web of material. Each roll forming station is adjustable as relating to a dimensional characteristic of the flange to be produced or operated upon by the station, e.g., flange height. The apparatus includes an adjustment mechanism, operably connected to the roll forming stations, for adjusting the roll forming stations concurrently together. (By "concurrent" adjustment, it is meant that operation of an adjustment drive unit, e.g., a motor or hand crank, causes the roll forming stations to be adjusted at the same time, without the need for any manual interaction with the roll forming stations, such as tool changeover.)

In another embodiment, the roll forming stations are infinitely adjustable within a set range defined by maximum and minimum values for the flange dimensional characteristic(s), e.g., flange height. Operation of the adjustment mechanism causes the roll forming stations to be infinitely adjusted within the set range. ("Infinite" adjustment refers to adjustment without set or predefined values within the maximum and minimum limits.)

In another embodiment, each roll forming station includes one or more roll forming pairs. (Most typically, each station will include upper and lower roll forming pairs, which cooperate for forming the flange or some portion thereof.) Each roll forming pair includes a first roll forming portion and a second roll forming portion that is coaxial with the first roll forming portion and axially moveable towards and away from the first roll forming portion. (The two roll forming portions are in effect a laterally split roll forming die, where the distance between the split portions is adjustable.) The adjustment mechanism includes an adjustment drive unit, e.g., a motor or hand crank and related structure, and an adjustment linkage assembly. The adjustment linkage assembly rotatably supports the second roll forming portions, and establishes their respective axial positions, i.e., when the linkage assembly is moved or shifted, the second roll forming portions move along with the linkage assembly, while remaining rotatable with respect thereto. When the adjustment drive unit is operated, this shifts the adjustment linkage assembly, thereby shifting the second roll forming portions towards or away from the first roll forming portions. The adjustable distance between the first and second roll forming portions is proportional to the height of the flange produced by the apparatus.

In another embodiment, the adjustment drive unit includes an adjustment drive motor and a screw member, and the adjustment linkage assembly includes a screw adaptor threaded on the screw member and a bearing support sub-assembly attached to the screw adaptor. (Typically, there will be more than one screw member and screw adaptor.) The bearing support sub-assembly rotatably supports the second roll forming portions. In operation, when the screw member is caused to rotate by the adjustment drive motor, the screw adaptor, prevented from rotating because of the connection between the bearing support sub-assembly and the second roll forming portions or otherwise, is shifted along the length of the screw member. This shifts the bearing support sub-assembly and thereby the second roll forming portions towards or away from the first roll forming portions. Use of a screw member and screw adaptor facilitates infinite adjustment of the spacing between the first and second roll forming portions, and provides for an accurate yet adjustable positioning of the second roll forming portions, e.g., after being positioned, the second roll forming portions are resistant to unwanted axial movement resulting from machine vibration or the like.

In another embodiment, each roll forming pair (e.g., the first and second portions of the split roll forming die) is carried on a rotating spindle, which is directly or indirectly driven by the main motor or other drive unit of the flange forming apparatus. The first roll forming portion is fixed to the spindle. The second roll forming portion is moveable along at least part of the spindle, e.g., as defined by a key slot formed in the spindle or in the second roll forming portion and a key attached to the other one of the spindle or the second roll forming portion. The bearing support sub-assembly rotatably supports the spindle and second roll forming portion. Movement of the adjustment linkage assembly, through actuation of the adjustment drive unit, causes the second roll forming portion to move axially along the spindle.

In another embodiment, in the case where the flange forming apparatus includes a number of screw members, the screw members may be interconnected by a chain drive. Here, actuation (e.g., rotation) of one of the screw members, or the chain drive directly, by the adjustment drive motor causes all the screw members to rotate in concert.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
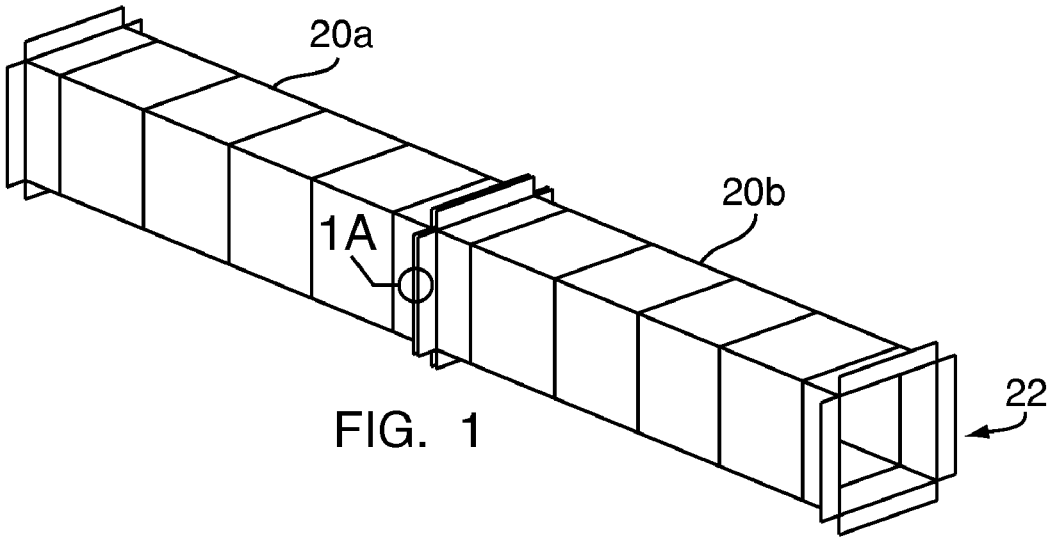
FIG. 1 is a perspective view of two sections of metal ductwork, arrayed end-on-end for connection thereof.
Figure 1A:
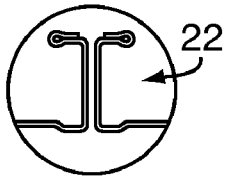
FIGS. 1A and 1B are cross section views of a transverse flange formed in each of the ductwork sections.
Figure 1B:
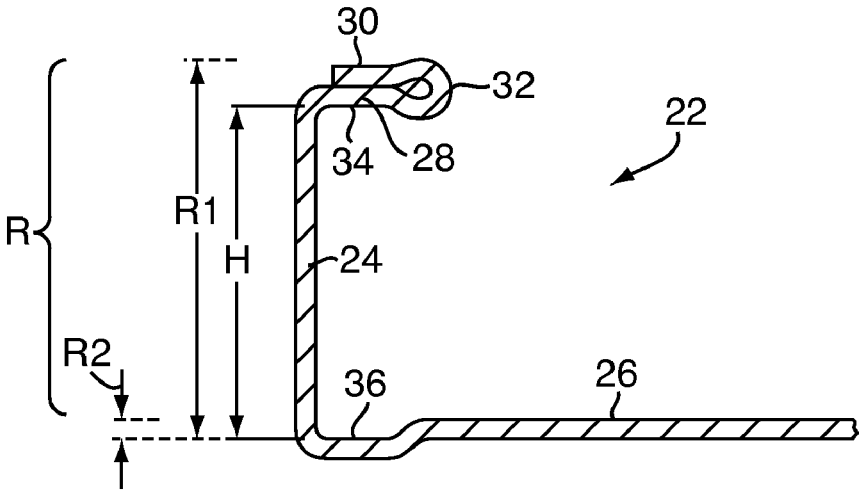
Figure 2:
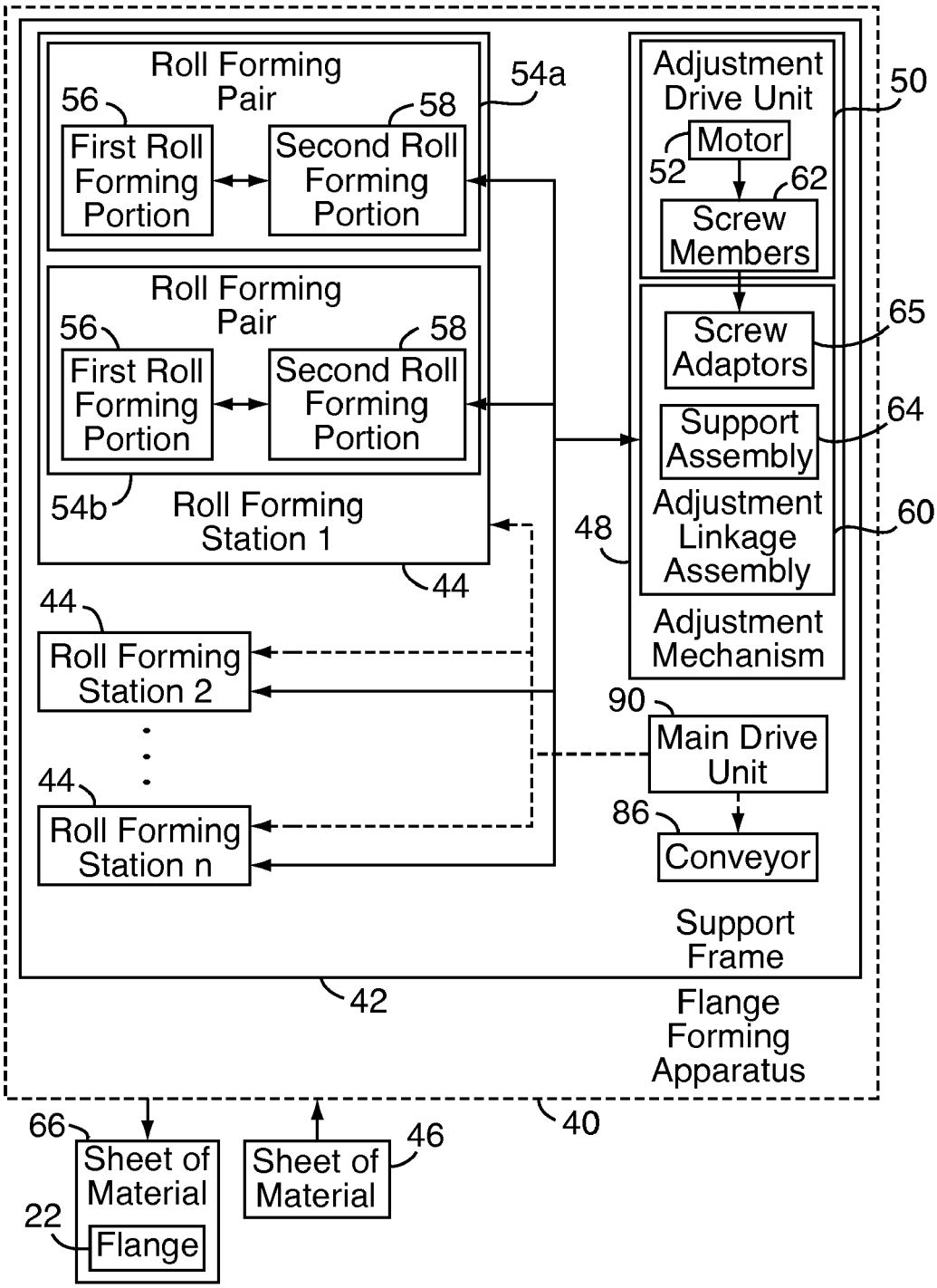
FIG. 2 is a partial schematic view of a flange forming device or apparatus according to an embodiment of the present invention.

In overview, with reference to FIGS. 1-10, a flange forming device or apparatus 40 includes a support frame 42 and a number of adjustable roll forming stations 44 carried on the support frame 42 for forming a flange 22 in a sheet or web of material 46. Each roll forming station 44 is infinitely adjustable as relating to a dimensional characteristic of the flange to be produced or operated upon by the station, e.g., flange height "H," within a set range "R" defined by maximum and minimum values "R1," "R2," respectively, for the flange height or other dimensional characteristic(s). (One example of a typical height range is 19 to 40 mm.) The device includes an adjustment mechanism 48, operably connected to the roll forming stations 44, for infinitely adjusting the roll forming stations 44 concurrently together. Thus, in operation, actuation of an adjustment drive unit 50, which includes an adjustment motor 52 or hand crank, causes the roll forming stations 44 to be adjusted at the same time, without the need for any manual interaction with the roll forming stations.

Typically, each of the adjustable roll forming stations 44 will include upper and lower roll forming pairs 54*a*, 54*b*, which cooperate for carrying out one of the successive forming operations used to form the flange 22. (For example, the first station might form an initial bend or formation in the web 46, with subsequent stations further bending or otherwise manipulating the web to form the flange 22 at the output of the apparatus 40.) Each roll forming pair 54*a*, 54*b* includes a first roll forming portion 56, e.g., a roll forming die or portion thereof, and a second roll forming portion 58 coaxial with the first roll forming portion (see, e.g., axis "L" in FIG. 9) and axially moveable towards and away from the first roll forming portion 56. The adjustment mechanism 48 includes the adjustment drive unit 50 and an adjustment linkage assembly 60. The adjustment linkage assembly 60 rotatably supports the second roll forming portions 58, and establishes their respective axial positions with respect to the first roll forming portions 56, i.e., when the adjustment linkage assembly 60 is moved or shifted, the second roll forming portions 58 move along therewith, while remaining rotatable with respect thereto. When the adjustment drive unit 50 is operated, this shifts the adjustment linkage assembly 60, thereby shifting the second roll forming portions 58 towards or away from the first roll forming portions 56. The height "H" of the flange produced by the device is proportional to the adjustable distance "D" between the first and second roll forming portions 56, 58, i.e., as D increases, H increases.

In one embodiment, the adjustment drive unit 50 includes one or more screw members 62 that are rotatably driven by the adjustment motor 52. The adjustment linkage assembly 60 includes a bearing support sub-assembly 64 and one or more screw adaptors 65 fixed to the bearing support sub-assembly. The bearing support sub-assembly 64 rotatably supports the second roll forming portions 58. The screw adaptors 65 are threaded on respective ones of the screw members 62. In operation, when the screw members 62 are caused to rotate by the adjustment drive motor 52, the screw adaptors 65 are shifted along the length of the screw members 62, thereby shifting the bearing support sub-assembly 64 and the second roll forming portions 58 towards or away from the first roll forming portions 56. As noted above, use of screw members and screw adaptors facilitates infinite adjustment of the spacing between the first and second roll forming portions, and provides for an accurate yet adjustable positioning of the second roll forming portions, e.g., after being positioned, the second roll forming portions are resistant to unwanted axial movement resulting from machine vibration or the like.

The various portions of the flange forming apparatus 40, and the operation thereof, will now be described in additional detail, with reference to the figures.

Figure 3A:
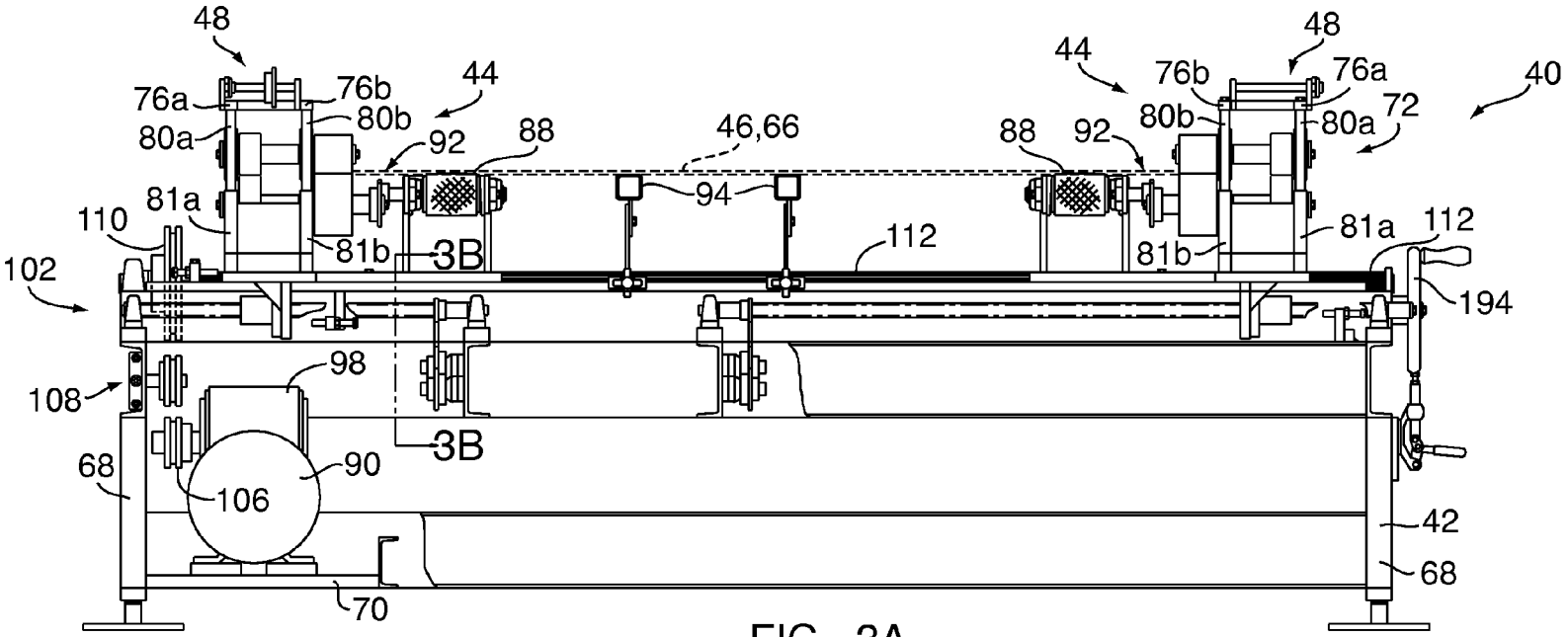
FIG. 3A is a lateral cross section view of the flange forming apparatus, taken along line 3A-3A in FIG. 4 or thereabouts.
Figure 4:
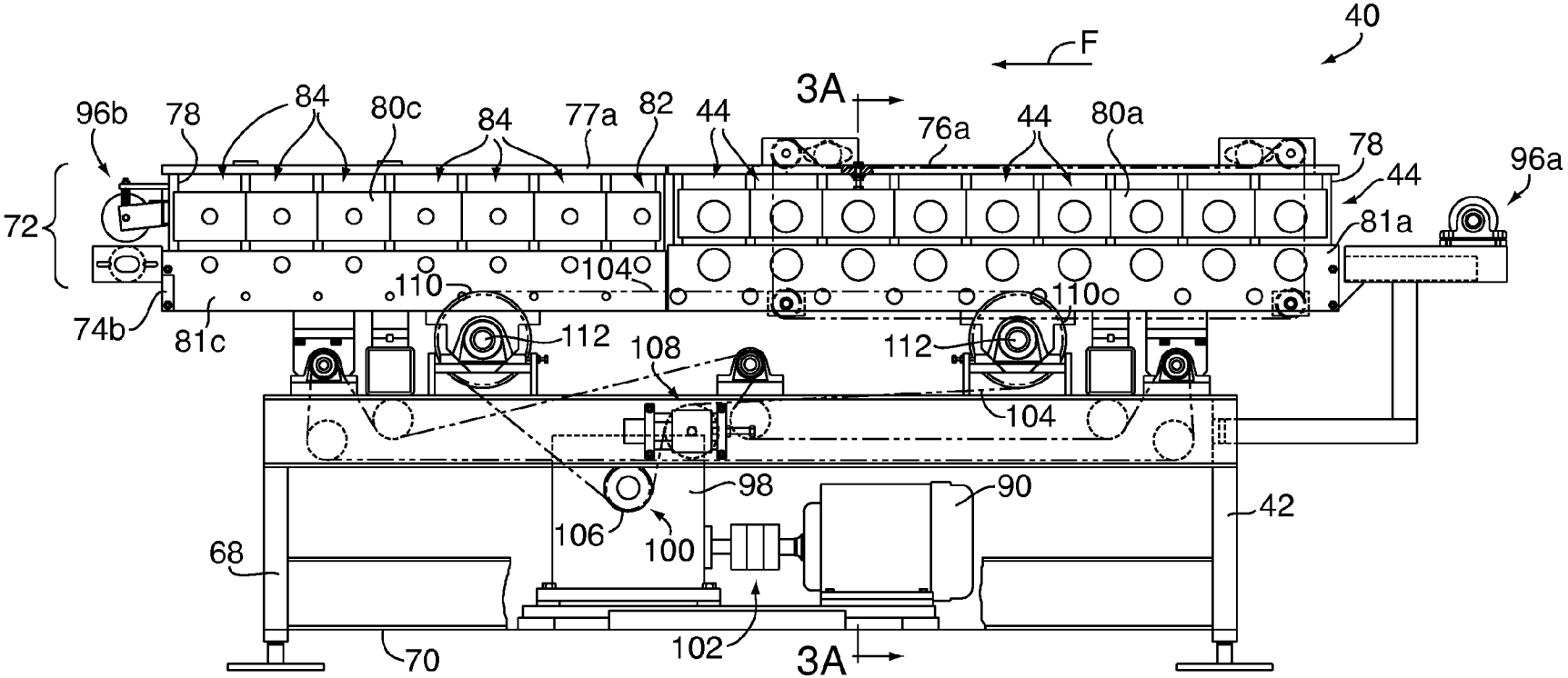
FIG. 4 is a first side elevation view of the flange forming apparatus.
Figure 10:
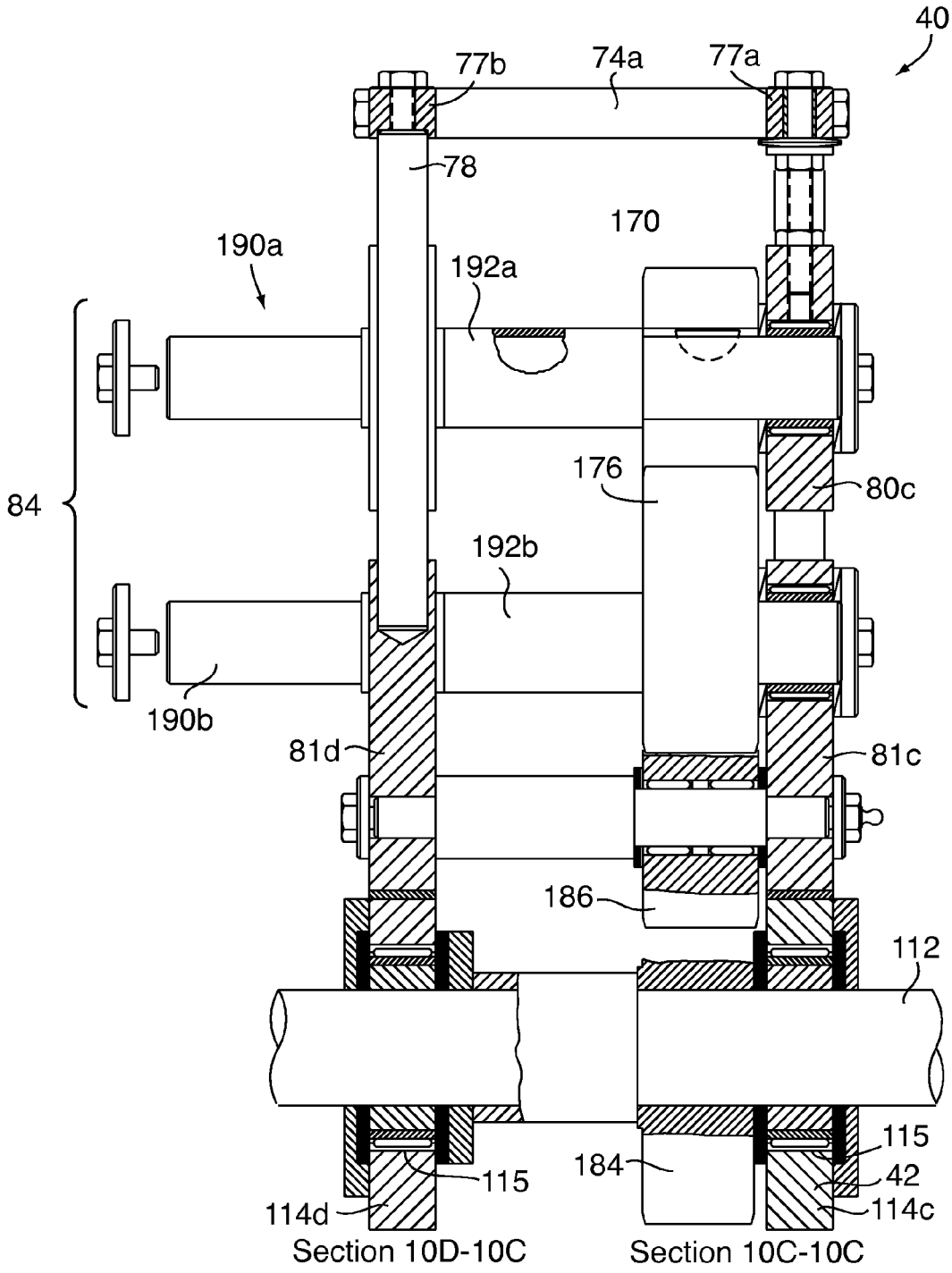
FIG. 10 is a second lateral cross section view of the flange forming apparatus in FIG. 8, taken along line 10D-10C and line 10C-10C in FIG. 8.

FIG. 3A shows a lateral cross section of the flange forming apparatus 40, viewed from the perspective of the exit end, that is, the end from which a finished sheet or web of material 66 exits the apparatus. FIG. 4 shows one side of the apparatus. As indicated, the flange forming apparatus 40 includes the support frame assembly 42, which is a stationary unit that holds and supports certain portions of the apparatus. The support frame 42 includes various support legs 68, cross and frame members 70, and the like. A generally rectangular, horizontal bed 72 is positioned atop the support frame. The bed 72 is defined by various structural and other members that include upper and lower lateral spreaders 74*a*, 74*b* (upper spreader 74*a* is shown in FIG. 10), longitudinal head rails 76*a*, 76*b*, 77*a*, 77*b*, various vertical posts 78, upper bearing blocks 80*a*-80*d*, lower bearing blocks 81*a*-81*d*, bearing cages 82, and the like.

The adjustable roll forming stations 44 are arrayed sequentially along either longitudinal side of the bed 72, for forming flanges in both edges of the web 46, or otherwise forming or manipulating both edges of the web. (Alternatively, roll forming stations can be arrayed along one side of the bed only, for forming a flange in one side of the web.) In the embodiment of the apparatus shown in FIG. 4, nine adjustable roll forming stations 44 are provided on each side of the bed 72, arrayed sequentially one after the other, starting at the infeed end of the apparatus. (Material flow is indicated by arrow "F.") The adjustable roll forming stations 44 are supported at least partly by outer and inner head rails 76*a*, 76*b*, outer and inner upper bearing blocks 80*a*, 80*b*, and outer and inner lower bearing blocks 81*a*, 81*b*. Located downstream of the adjustable roll forming stations 44, each side of the bed 72 is similarly provided with seven non-adjustable roll forming stations 84, arrayed sequentially one after the other. The non-adjustable roll forming stations perform finishing or secondary operations for which adjustment is not required, and are supported at least partly by outer and inner head rails 77*a*, 77*b*, outer and inner upper bearing blocks 80*c*, 80*d*, and outer and inner lower bearing blocks 81*c*, 81*d*.

For guiding the web or sheet of material 46 through the flange forming apparatus 40, the apparatus is outfitted with a conveyor system or assembly 86. The conveyor system 86 includes at least two primary conveyor drive units 88 (e.g., belts or roller-type mechanisms), which are located on either side of the bed 72, proximate to the roll forming stations 44, 84. The primary conveyor drive units 88 are driven in a standard manner, e.g., using mechanical power originating from a main motor unit 90 and applied through a gear system 92, for moving the web 46 from the infeed end of the apparatus to the exit or outfeed end of the apparatus. Intermediate rollers or other supports 94 may be provided as part of the conveyor system 86 for supporting the web 46 between the primary conveyor drive units 88. Additionally, the infeed and outfeed ends of the apparatus may be provided with Stilson-type roll assemblies 96*a*, 96*b*, respectively. (Typically, the conveyor system is used only in a bypass mode, or when the web is not being formed into flanges. It is operable at all times while the machine is running. When the web is being formed into flanges, the rolling action of the roll forming station conveys the web through the apparatus.)

The primary drive system of the flange forming apparatus 40, for powering the conveyor system 86 and roll forming stations, includes the main drive motor 90, a reducer 98, and a drive gear system 100. The drive motor 90 is a heavy duty AC or DC motor (e.g., 10 hp), which is powered and controlled by a standard motor controller (not shown). The output shaft of the motor 90 is connected to the reducer 98 by way of a flexible coupling 102. The reducer 98 is used to convert the motor output to a speed/torque range suitable for the drive gear system 100. A double drive chain 104, driven by a primary drive sprocket 106 attached to the output of the reducer 98, extends around an idler unit 108 and one or more secondary drive sprockets 110. (Two secondary drive sprockets 110 are shown in FIG. 4, one for each group of roll forming stations.) The secondary drive sprockets 110 each drive a Grob™ spline shaft 112, which extend across and below the bed 72 and are supported below the lower bearing blocks 81*a*-81*d* in spline shaft bearing plates 114*a*-114*d*. For example, as shown in FIG. 10, the spline shafts 112 may be rotatably supported in the bearing block by way of needle bearing assemblies, thrust bearings, or the like 115.

The adjustment mechanism 48 includes the adjustment drive unit 50, which itself includes the drive motor 52 and the screw members 62, and the adjustment linkage assembly 60, which comprises a unitary assembly (i.e., the adjustment linkage assembly moves as a unit) of the screw adaptors 65 connected to the bearing support sub-assembly 64. These components are shown in particular in FIGS. 7, 8, and 9. The adjustment drive unit 50 includes the adjustment drive motor 52 (e.g., a DC gear motor), a primary adjustment drive sprocket 116 attached to the output shaft of the motor 52, an adjustment drive chain 118, an idler unit 120, and a secondary adjustment drive sprocket 122. The idler unit 120 includes a chain tightener 124, an idler shaft 126, and an idler sprocket 128 on the idler shaft 126. The idler unit 120 is attached to and at least partly supported by a bearing mount and chain tightener support 130. The adjustment chain 118 is disposed about the drive sprocket 116, and extends to the idler unit 120 and about the secondary adjustment sprocket 122. The adjustment gear motor 52 is attached to and supported by a motor mount plate 132, which is fixedly attached to the outer head rail 76*a* and slidably attached to the inner head rail 76*b* by spool assemblies 134. The adjustment gear motor 52 is controlled using a standard electric motor controller and control system (not shown).

Figure 7:
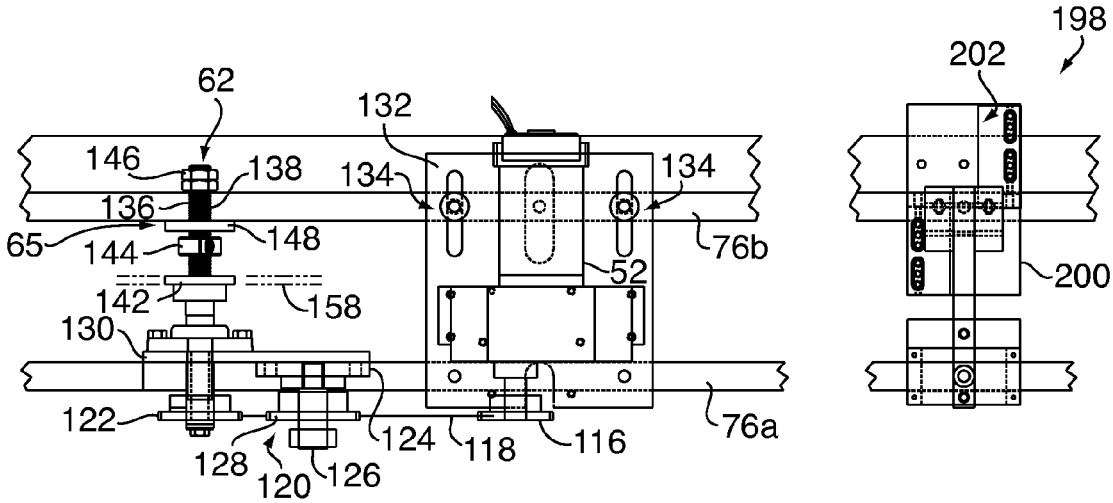
FIG. 7 is a top plan view of part of the flange forming apparatus shown in FIG. 5, taken along line 7-7 in FIG. 5.
Figure 8:
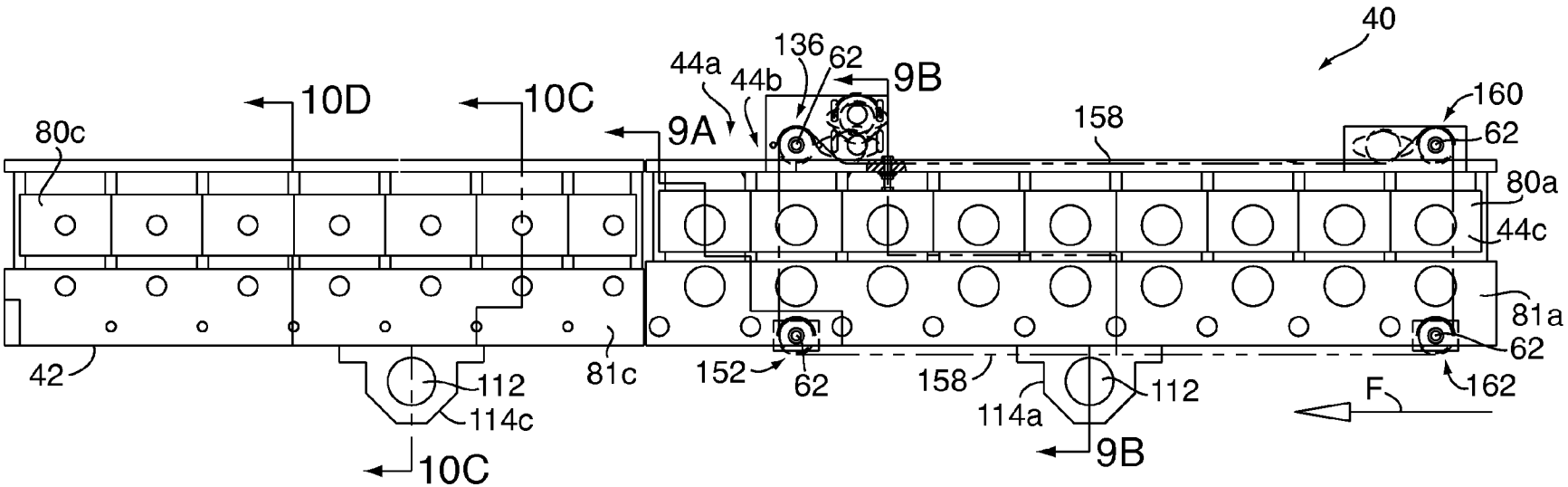
FIG. 8 is a third side elevation view of the flange forming apparatus.
Figure 9:
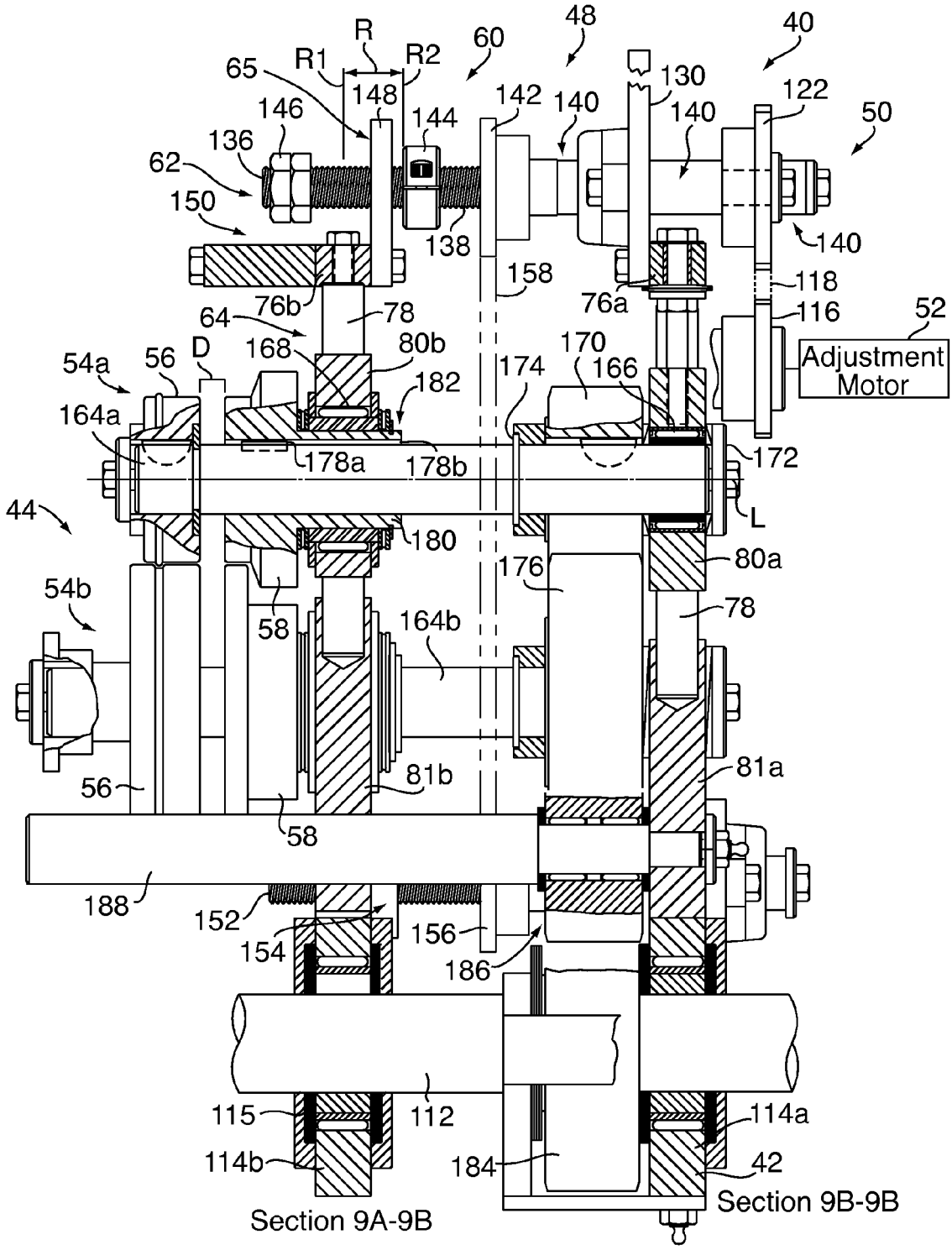
FIG. 9 is a lateral cross section view of part of the flange forming apparatus in FIG. 8, taken along line 9B-9B and line 9A-9B in FIG. 8.

With reference to FIGS. 7-9 (note that the motor 52 is not shown in FIG. 8), operation of the adjustment drive motor 52 causes the secondary adjustment sprocket 122 to rotate, which in turn causes one of the screw members 62, e.g., a shaft-like upper lead screw member 136, to rotate. At least a fore part of the upper lead screw member 136 is provided with threads 138. The rest of the lead screw member 136 is optionally unthreaded. The lead screw member 136 is rotatably attached to and supported by the bearing mount and chain tightener support 130, and also by the adjustment linkage assembly 60. Carried on the lead screw member 136 are various spacers 140, for positioning the lead screw member 136, and a follower adjustment sprocket 142. Disposed on the threaded portion 138 of the lead screw member 136 are a threaded set collar 144, which is set back from the end of the threaded portion 138, and a lock nut assembly or second threaded set collar 146, which is located proximate to (or at) the end of the threaded portion 138. One of the screw adaptors 65, e.g., an upper threaded lead screw adaptor 148, is also threaded on the lead screw member 136 between the set collar 144 and lock nut assembly 146. The upper lead screw adaptor 148 is part of the adjustment linkage assembly 60, which includes the bearing support sub-assembly 64 and the screw adaptors 65 (collectively) connected to the bearing support sub-assembly 64. The bearing support sub-assembly 64 includes the inner head rail 76*b*, which is optionally outfitted with a stiffening bar 150, and the inner upper and lower bearing blocks 80*b*, 81*b* attached thereto. The upper lead screw adaptor 148 is attached to the inner head rail 76*b*.

A lower lead screw member 152, lying parallel to and generally below the upper lead screw member 136 in the area of the lower bearing blocks 81*a*, 81*b*, is rotatably attached to and supported by the outer lower bearing block 81*a* or otherwise. Like the upper lead screw member 136, the lower lead screw member 152 includes a fore threaded portion. A lower lead screw adaptor 154 (again, part of the adjustment linkage assembly 60) is threaded on the lower lead screw adaptor 152, and attached to the lower inner bearing block 81*b*. A lower lead screw sprocket 156 is attached to the lower lead screw member 152 in alignment with the follower adjustment sprocket 142 attached to the upper lead screw member 136. The lower lead screw sprocket 156 and the follower adjustment sprocket 142 are interconnected by an adjustment chain 158, which also extends around similar screw members 62 at one or more of the other roll forming stations 44. For example, as shown in FIG. 8, the block of adjustable roll forming stations 44 includes four screw members 62: the upper and lower lead screw members 136, 152, located generally towards the outfeed end of the stations 44, and upper and lower secondary screw members 160, 162 located at the infeed end of the stations 44. Each screw member 62 is outfitted with a sprocket, and the sprockets are interconnected by the adjustment chain 158.

Whereas the outer bearing blocks 80*a*, 81*a* and head rail 76*a* are fixed in place, at least in relation to the adjustment mechanism 48 portion of the flange forming apparatus 40, the inner head rail 76*b*, bearing blocks 80*b*, 81*b*, and screw adaptors 148, 154 (which are interconnected to one another to form the adjustment linkage assembly 60) float together as a unit, and are moveable towards and away from the outer bearing blocks. The assembly 60 is supported and kept in vertical alignment by the screw members 62, by the roll forming pairs 54*a*, 54*b* (as discussed in more detail below), and through attachment of the lower inner bearing block 81*b* to an inner one of the spline shaft bearing plates 114*b*, which is in turn supported by the spline shaft 112. (Alternatively or in addition, the assembly 64 can be slidably supported on frame members located below the assembly.) The position of the adjustment linkage assembly 60 is established by the screw members 62. In particular, when the adjustment motor 52 is controlled to rotate the upper lead screw member 136 in one direction, the other screw members are concurrently similarly rotated, by way of the sprockets 142, 156 and chain 158 interconnection. As the screw members 62 rotate, the screw adaptors 65, threaded on the screw members, are caused to move along the screw members in one direction, thereby shifting the rest of the assembly 60 in the same direction. The screw adaptors 65 are prevented from rotating along with the screw members 62 by virtue of their connection to the rest of the assembly 60, which is constrained through its connection to the roll forming pairs 54*a*, 54*b*. When the adjustment motor 52 is controlled to rotate the upper lead screw member 136 in the other direction, the screw adaptors and other portions of the assembly 60 are shifted in the other direction.

As mentioned above, and momentarily referring back to FIG. 7, the motor mount plate 132 is fixedly attached to the outer head rail 76*a* but slidably attached to the inner head rail 76*b* by the spool assemblies 134. This is because the inner head rail 76*b* shifts along with the rest of the adjustment linkage assembly 60 during actuation of the adjustment drive unit 50.

Each roll forming pair 54*a*, 54*b* is supported on a rotatable roller die spindle 164*a*, 164*b*, respectively. The upper spindle 164*a* is rotatably supported by the upper bearing blocks. More specifically, the upper spindle 164*a* extends through (i) an aperture in the outer upper bearing block 80*a*, which is outfitted with a bearing 166, and (ii) through an aperture in the inner upper bearing block 80*b*, which is outfitted with a needle-type bearing assembly 168. An upper spindle gear 170 is fixedly attached to the upper spindle 164*a* just inside the outer upper bearing block 80*a*. The upper spindle 164*a* is kept in place axially by an outer washer or retainer assembly 172, located on the outer side of the outer upper bearing block 80*a*, and a C-ring assembly 174 abutting the inner side of the spindle gear 170. The lower spindle 164*b*, outfitted with a lower spindle gear 176, is similarly supported in the outer and inner lower bearing blocks 81*a*, 81*b*.

With reference to FIG. 9, the first roll forming portion 56 of the upper roll forming pair 54*a* (e.g., one part of a split roll forming die) is fixedly attached to a first end of the upper spindle 164*a*, distal from the second end of the spindle that is rotatably supported by the outer upper bearing block 80*a*. The first roll forming portion 56 rotates along with the spindle 164*a*, and is prevented from moving axially along the spindle 164*a*. The second roll forming portion 58 is also attached to the spindle 164*a*, but closer to the second end of the spindle, to one side of the first roll forming portion 56. The second roll forming portion 58 rotates along with the spindle 164*a*. Additionally, the second roll forming portion 58 is slidable along a portion of the length of the spindle 164*a*. For allowing the second roll forming portion 58 to slide along and rotate with the spindle 164*a*, a key- or spline-type connection may be used between the spindle and second roll forming portion. In the case of a key-type connection 178, the spindle 164*a* is provided with one or more axially oriented keys 178*a* attached thereto. The central aperture of the second roll forming portion 58, through which the spindle extends, is provided with one or more radially extending keys slots 178*b*, which are configured to accommodate the keys attached to the spindle. The key slots are longer than the keys, allowing the second roll forming portion 58 to move axially along the spindle. When the spindle 164*a* is rotated, the spindle keys interact with the side walls of the key slots formed in the second roll forming portion, thereby rotating the second roll forming portion 58 along with the spindle.

In one embodiment, as shown in FIG. 9, the key slot(s) 178*b* formed in the second roll forming portion 58 extends along the entire longitudinal length of the second roll forming portion. Here, the key slot allows for (i) the second roll forming portion to slide along the spindle and (ii) the spindle to rotate the second roll forming portion, but the key/key slot interaction does not act as a limiting factor in terms of the extent to which the second roll forming portion can move along the spindle.

As should be appreciated, in regards to a key-type connection 178 between the spindle and second roll forming portion, either element may be outfitted with one or more keys and the other element outfitted with a corresponding number of key slots.

In addition to the part that acts as a roll forming die, the second roll forming portion 58 includes an integral neck member 180. The neck member 180 is concentrically disposed between the spindle 164*a* and the needle bearing assembly 168. The neck member 180 is free to rotate within the needle bearing assembly 168. Thereby, the entire second roll forming portion 58 is rotatably supported by the needle bearing assembly 168 and rotatable with respect to the adjustment linkage assembly 60. Additionally, the second roll forming portion 58 is maintained in the needle bearing assembly 168 by a retaining ring and thrust race assembly 182. In this manner, thereby: (i) the second roll forming portion 58 is rotated by the spindle 164*a*; (ii) the second roll forming portion 58 and spindle 164*a* are rotatably supported by the needle bearing assembly 168, which is carried in the bearing support sub-assembly portion of the adjustment linkage assembly; (iii) the second roll forming portion 58 can be slid axially along a portion of the spindle 164*a*; and (iv) the second roll forming portion 58 is rotatably connected to the needle bearing assembly 168 bearing support sub-assembly 64, such that the axial position of the second roll forming portion 58 along the spindle 164*a* is established by the adjustment linkage assembly 60, i.e., when the adjustment linkage assembly 60 is shifted left or right, the second roll forming portion 58 moves along therewith, along the spindle 164*a*. Because the first roll forming portion 56 is axially stationary, this changes the distance "D" between the first and second roll forming portions 56, 58.

The lower roll forming pair 54*b* and the lower roller die spindle 164*b* are configured similarly to the upper roll forming pair 54*a* and upper roller die spindle 164*a*, as described above, e.g., the second roll forming portion 58 of the lower roll forming pair 54*b* moves towards or away from the first roll forming portion 56 when the adjustment linkage assembly 60 is shifted laterally.

The range "R" through which the adjustment linkage assembly 60 may be shifted is defined by several elements. These include the threaded set collar 144 and lock nut assembly 146 on the upper lead screw member 136 (the threaded set collar 144 sets the absolute maximum, the lock nut assembly the absolute minimum), the length of possible travel of the second roll forming portions 58 along the spindles 164*a*, 164*b* (e.g., defined by the length of the key slot), and the first roll forming portions 56 at the ends of the spindles 164*a*, 164*b*. In the embodiment shown in FIG. 9, the absolute minimum "R1" (for the overall apparatus) is defined by the positioning of the first roll forming portions 56, and the absolute maximum "R2" is defined by the length of the key slot in the second roll forming portion(s). In other words, the minimum possible distance between the two roll forming portions is when the second portion abuts the first portion, and the maximum possible distance between the two is defined by how far the second roll forming portion can move along the spindle away from the first roll forming portion. Within this maximum range, the actual range of travel can be adjusted by changing the positions of the threaded set collar 144 (which may be adjusted to set the actual maximum R2) and the lock nut assembly 146 (which may be adjusted to set the actual minimum R1). Of course, if the set collar or lock nut assembly are positioned outside the absolute maximum or minimum range, then the actual range is established by other limiting elements, e.g., the key slots or first roll forming portions. Also, motorized movement may be limited by using adjustable limit switches or sensors setting R2 and R1.

For carrying out forming operations on a web 46, for a single station 44, it is typically the case that the web is conveyed between the upper roll forming pair 54*a* and the lower roll forming pair 54*b*, each of which acts as a roll forming die, and which are set to rotate at a particular speed. (Although industry parlance sometimes characterizes a roll forming "pair" as being an upper roll forming die in conjunction with a lower roll forming die, in the present application the term "pair" is used in a slightly different sense, to refer to the two parts 56, 58 of an adjustable, split roll forming die.) The roll forming pairs 54*a*, 54*b* are aligned axially and offset laterally (e.g., the two pairs are laterally or radially adjacent), and are shaped in a standard, complementary manner depending on the roll forming operation to be carried out. For driving the roll forming pairs 54*a*, 54*b*, the spline shaft 112 is rotated (see FIG. 4 and accompanying description above), which in turn causes a spline gear 184 attached to the spline shaft 112 to rotate. The spline gear 184, aligned with the lower spindle gear 176, causes the lower spindle gear 176 to rotate, either directly by being meshed therewith, or indirectly through an idler gear 186 carried on an idler shaft 188. Rotation of the lower spindle gear 176 causes the lower spindle 164*b* and lower roll forming pair 54*b* to rotate. Meshed with the upper spindle gear 170, rotation of the lower spindle gear 176 also causes the upper spindle gear 170 to rotate, which rotates the upper spindle 164*a* and upper roll forming pair 54*a*.

FIG. 10 shows one of the non-adjustable roll forming stations 84 in cross section. Each station 84 includes upper and lower roller dies 190*a*, 190*b*, which are disposed on upper and lower spindles 192*a*, 192*b*, respectively. The spindles extend between and are rotatably supported by the bearing blocks. Rotation of the spindles 192*a*, 192*b* is carried out through a gear system, e.g., gears 184, 186, 176, and 170, similarly to as explained above in regards to FIG. 9.

To summarize operation of the adjustment mechanism 48, for changing the distance "D" between the first and second roll forming portions 56, 58 of the roll forming pairs 54*a*, 54*b* in all the adjustable stations 44 concurrently, the adjustment drive unit 50 is actuated in a standard manner to rotate the upper lead screw member 136 in a desired direction. (Operation of the drive unit for rotation of the upper lead screw member in one direction causes the first and second roll forming portions to move closer together, and operation of the drive unit for rotation of the upper lead screw member in the other direction causes the first and second roll forming portions to move farther apart.) As the upper lead screw member 136 rotates, this causes the follower adjustment sprocket 142 to rotate, pulling the adjustment chain 158. Since the adjustment chain 158 interconnects the plurality of screw members 62 (see, e.g., FIG. 8), this causes all of the screw members 62 to rotate in concert. Each screw member 62 is outfitted with a screw adaptor 65 threaded thereon. The screw adaptors are in turn connected to the rest of the adjustment linkage assembly 60, e.g., to the bearing support sub-assembly 64, which includes the upper and lower inner bearing blocks 80*b*, 81*b*, various posts 78, the inner head rail 76*b*, etc. Thus, when the screw members 62 are caused to rotate, the screw adaptors 65 are caused to move along the screw members, shifting the adjustment linkage assembly 60 in the desired direction. Since the second roll forming portions 58 of all the stations 44 are rotatably connected to the bearing support sub-assembly 64 (and thereby to the adjustment linkage assembly 60 as a whole), whereas the first roll forming portions 56 and spindles 164*a*, 164*b* are axially stationary (at least in the context of the adjustment mechanism 48), shifting of the adjustment linkage assembly 60 causes the second roll forming portions 58 to concurrently move towards or away from the first roll forming portions 56, for all the stations 44.

Subsequent to adjustment, the spline shaft 112 is actuated, actuating the gear system 184, 186, 176, 170, and causing the roll forming pairs 54*a*, 54*b* to rotate. The roll forming stations 44 are firmly supported by the inner and outer bearing blocks (and related elements), and the adjustment linkage assembly 60 is prevented from moving axially because of the screw members 62, i.e., rotation of the screw members causes the screw adaptors to shift position, but vibration in the screw adaptors does not cause them to move along the screw members, due to the threaded connection between the screw members and screw adaptors. Next, or possibly concurrently, the conveyor system 86 is actuated, if necessary, and a web of metal or other material 46 is fed into the apparatus 40. The web 46 is conveyed through the apparatus 40, where it is roll formed by the stations 44, 84 to form a flange 22 therein. The finished web 66, now outfitted with one or more flanges 22, exits the apparatus 40. (As noted above, it is typically the case that the conveyor system is only used to convey the web in a bypass mode, with the roll forming stations pulling the web through the apparatus when flanges are to be formed.)

The adjustment mechanism 48 may include a position scale (not shown) that shows a user what flange height "H" will be produced by the flange forming apparatus according to its current state of adjustment. When the adjustment mechanism is actuated for adjusting the stations 44, the position scale shows the corresponding, newly adjusted flange height. Additionally, if the apparatus utilizes an adjustment motor 52 as part of the adjustment drive unit 50, the controller for controlling the motor can be provided with an electronic control sub-system that would enable a user to select or enter different flange heights, with the control sub-system causing the motor to be controlled to adjust the stations 44 to effectuate the designated flange height.

Figure 3B:
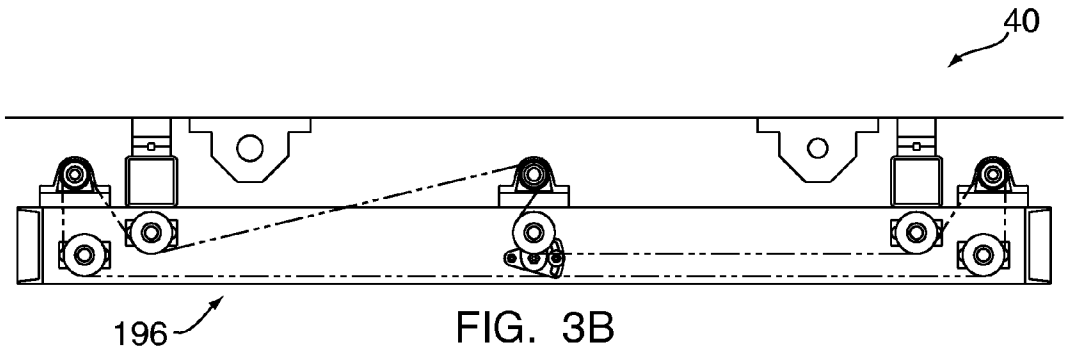
FIG. 3B is a cross section view of part of the flange forming apparatus, taken along line 3B-3B in FIG. 3A.
Figure 5:
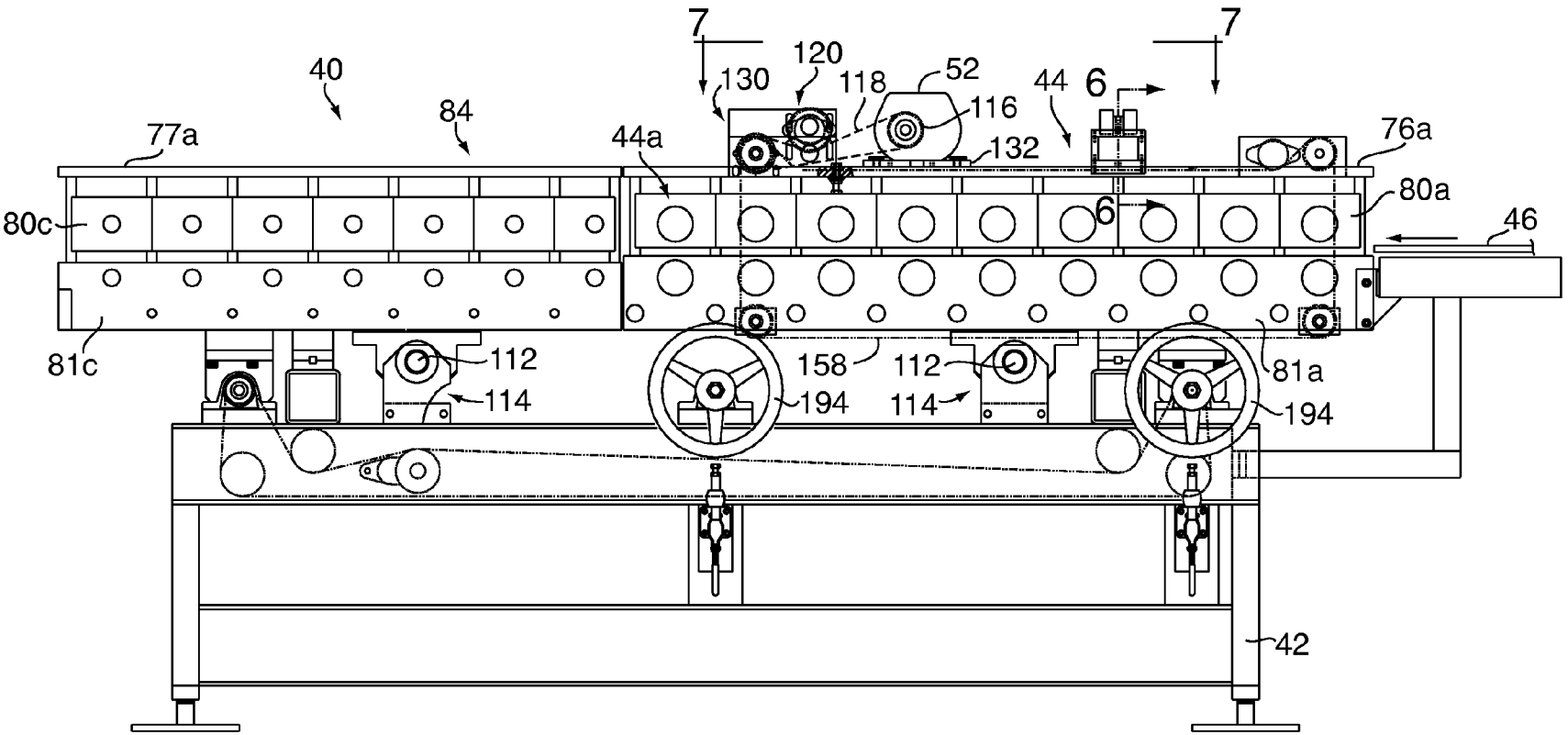
FIG. 5 is a second side elevation view of the flange forming apparatus.

The flange forming apparatus 40 also includes a mechanism for adjusting the overall width of the bed 72, within predetermined limits, for accommodating different sized sheets of material. The width adjustment system is shown in FIGS. 3A, 3B, and 5. In one embodiment, the apparatus 40 is designed to process a web of material that can be between 36 inches and 72 inches wide (91-182 cm). The position of the two roll forming heads can be adjusted using the hand cranks 194 shown in FIGS. 3A and 5. Rotating one hand crank will move the near (or operator side) head into position with the web. Rotating the other hand crank will move the far (or guide side) head into position with the web. The hand cranks 194 are also used to move the heads out of position when forming of the web is not required. In this position the web will move through the machine on the conveyor without flanges being formed. The chain mechanism 196 in FIG. 3B connects the pair of lead screws to the single hand crank, in each case.

Figure 6:
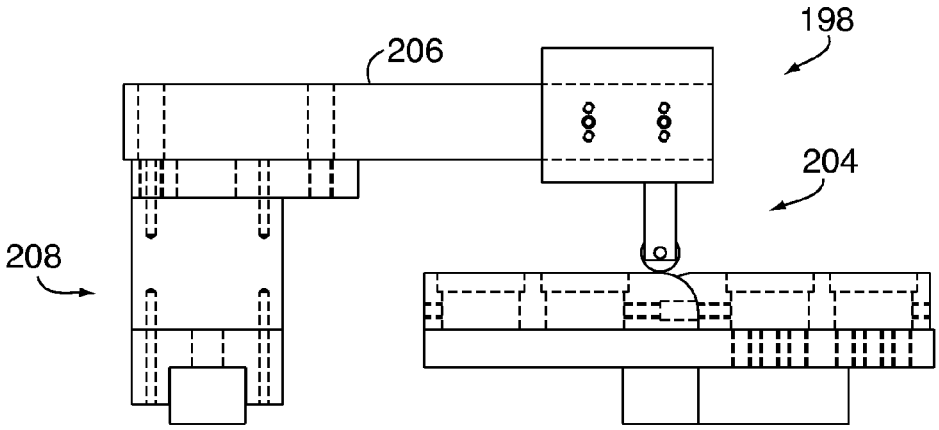
FIG. 6 is a cross section view of a limit switch mount portion of the flange forming apparatus shown in FIG. 5, taken along line 6-6 in FIG. 5.

FIG. 6 shows a mounting plate assembly 198, which supports various limit switches that control the adjustment drive motor 52, e.g., the limit switches may be used to ensure that the motor does not attempt to cause the adjustment linkage assembly 60 to move past set boundaries. (See also FIG. 7.) The assembly 198 includes a plate mount 200, a limit switch trip 202, a roller type micro switch 204, a limit switch mount 206, and a limit switch head rail mount 208.

If the flange forming apparatus is provided with adjustable roll forming stations 44 on both sides of the main bed, each side will typically be provided with its own adjustment mechanism 48. The adjustable stations may be controlled all together, or on a side-by-side basis.

An embodiment of the present invention may be characterized as including: a support frame; a plurality of adjustable roll forming means (stations 44) attached to the support frame for forming a flange in a sheet of material 46; and adjustment means (adjustment drive unit 50, including a motor 52 or hand crank and screw members 62 rotated thereby, adjustment linkage assembly 60, including the screw adaptors 65 and the bearing support sub-assembly 64, and related elements) attached to the support frame and operably interfaced with the plurality of adjustable roll forming means for adjusting the roll forming means concurrently together, e.g., the adjustment linkage assembly, positioned by the screw members, rotatably supports and positions the second roll forming portions 58.

Although the flange forming apparatus has been illustrated as utilizing an adjustment gear motor 52, an adjustment hand crank could be used instead without departing from the spirit and scope of the invention. Thus, the adjustment drive unit 50 can includes hand cranks, motors, and similar components, along with the supporting accoutrement there for.

As should be appreciated, although the roll forming stations have been generally illustrated as included two roll forming pairs, each with first and second roll forming portions, e.g., roll forming dies, the present invention contemplates that the stations in some instances could instead include only one roll forming pair, or more than two roll forming pairs, with or without additional roll forming elements, such as non-adjustable roll forming dies or the like.

As should be appreciated, in addition to the upper lead screw member having a threaded set collar and/or lock nut assembly, the other screw members may be provided with similar components.

As indicated above, the flange forming apparatus can be used to form different types of flanges, including TDC® and TDF® flanges. To configure the apparatus for producing a particular type of flange, the roll forming stations are outfitted with the appropriate types of roll forming dies for the flange in question.

Since certain changes may be made in the above-described adjustable flange forming apparatus, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A flange forming apparatus comprising:

a support frame;

a bed positioned atop the support frame, said bed having a width;

a plurality of roll forming stations attached to the support frame along either or both longitudinal sides of said bed for forming a flange in a sheet of material, wherein each of the stations is adjustable in regards to a dimensional characteristic of the transverse flange to be produced or operated upon by the station;

first inner and outer head rails disposed along a longitudinal side of said bed;

second inner and outer head rails disposed along another longitudinal side of said bed, said first and said second inner and outer head rails supporting said plurality of roll forming stations;

a flange height adjustment mechanism attached to the support frame, said adjustment mechanism being operably connected to the plurality of roll forming stations for adjusting the roll forming stations concurrently together in said regards to a dimensional characteristic of the transverse flange to be produced; and a bed-width adjustment mechanism including a first hand wheel positioned along one of said longitudinal side of said bed, first lead screws and a first chain mechanism for connecting the first lead screws to the first hand wheel for adjusting a position of said first inner head rail upon rotation of said first hand wheel to concurrently adjust a position of all of said plurality of roll forming stations supported by said first inner head rail in relation to said second inner head rail, and a second hand wheel positioned along the same longitudinal side of said bed as said first hand wheel, second lead screws and a second chain mechanism for connecting the second lead screws to the second hand wheel for adjusting a position of said second inner head rail upon rotation of said second hand wheel to concurrently adjust a position of all of said plurality of roll forming stations supported by said second inner head rail in relation to said first inner head rail, for adjusting said width of said bed for accommodating different sized sheets of material.

2. The flange forming apparatus of claim 1, wherein:

the roll forming stations are infinitely adjustable within a set range defined by maximum and minimum values for the flange dimensional characteristics.

3. The flange forming apparatus of claim 2, wherein, for each of said stations, the dimensional characteristic is a height of the flange.

4. The flange forming apparatus of claim 2, wherein:

each roll forming station includes at least one roll forming pair, said pair comprising first and second coaxial roll forming portions, said second roll forming portion being axially moveable towards and away from the first roll forming portion; and the flange height adjustment mechanism includes:

an adjustment drive unit; and an adjustment linkage assembly operably connected to the drive unit and to the second roll forming portions, said adjustment linkage assembly establishing respective axial positions of the second roll forming portions, wherein for each roll forming pair, operation of the drive unit causes the adjustment linkage assembly to change the axial position of the second roll forming portion with respect to the first roll forming portion and, thereby, a distance there between, said distance corresponding at least in part to the dimensional characteristic of the flange to be produced or operated upon by the station.

5. The flange forming apparatus of claim 4, wherein:

the adjustment drive unit includes a rotatably driven screw member; and the adjustment linkage assembly includes a bearing support assembly and a screw adaptor attached thereto and threaded on to the screw member, said bearing support assembly being operably interfaced with the second roll forming portions of the roll forming pairs for establishing the axial position thereof;

wherein actuation of the adjustment drive unit causes the screw member to rotate and the screw adaptor to move along the screw member, thereby shifting the bearing support assembly and changing the axial position of each second roll forming portion and the distance between it and its respective first roll forming portion.

6. The flange forming apparatus of claim 4, wherein:

the adjustment drive unit includes a plurality of rotatably driven screw members; and the adjustment linkage assembly includes a bearing support assembly and a plurality of screw adaptors attached thereto and respectively threaded on the screw members, said bearing support assembly being operably interfaced with the second roll forming portions for establishing the axial positions thereof;

wherein operation of the adjustment drive unit causes the screw members to rotate and the screw adaptors to respectively move along the screw members, thereby shifting the bearing support assembly and changing the axial positions of the second roll forming portions and the distances between them and respective first roll forming portions.

7. The flange forming apparatus of claim 6, wherein the screw members are interconnected by a chain drive, such that rotation of one of the screw members or the chain drive by a motor or hand crank portion of the adjustment drive unit causes all of said plurality of screw members to rotate in concert.

8. The flange forming apparatus of claim 7, wherein the adjustment drive unit comprises the motor, a sprocket connected to one of the screw members or to the chain drive, and a motor chain interconnecting the motor and sprocket.

9. The flange forming apparatus of claim 4, wherein the first and second roll forming portions of each roll forming pair are supported on and rotatably driven by a spindle, said first roll forming portion being fixed on the spindle and said second roll forming portion being axially moveable along the spindle.

10. The flange forming apparatus of claim 9, wherein:

the spindle includes an axially-oriented key slot formed therein;

the second roll forming portion is slidably attached to the spindle within the key slot, wherein rotation of the spindle causes the second roll forming portion to rotate through interaction of the key slot and second roll forming portion; and the spindle and the second roll forming portion extend through, and are rotatably supported by, a bearing carried in a bearing support assembly portion of the adjustment linkage assembly, said bearing support assembly establishing the position of the second roll forming portion along the key slot and thereby the distance between the second roll forming portion and its respective first roll forming portion attached to the spindle.

11. The flange forming apparatus of claim 2 wherein:

each roll forming station includes at least one roll forming pair, said roll forming pair comprising:

a first roll forming portion fixedly attached to a rotatable spindle, said first roll forming portion and said spindle being non-axially moveable with respect to one another; and a second roll forming portion attached to the spindle and coaxial with the first roll forming portion, said spindle being drivable to rotate the first and second roll forming portions, wherein the second roll forming portion is axially moveable along the spindle for adjustment of a distance between the first and second roll forming portions, said distance corresponding at least in part to the dimensional characteristic of the flange to be produced or operated upon by the station; and the flange height adjustment mechanism comprises:

an adjustment drive unit having a plurality of screw members configured for rotation by a motor or hand crank; and an adjustment linkage assembly comprising:

a bearing support assembly; and a plurality of screw adaptors attached to the bearing support assembly and respectively threaded on the screw members, said bearing support assembly rotatably supporting the spindle of the roll forming pair and being operably interfaced with the second roll forming portion of the roll forming pair for establishing an axial position of the second roll forming portion along the spindle;

wherein rotation of the screw members causes the screw adaptors to axially move along the screw members, said adaptors being prevented from rotation due to their attachment to the bearing support assembly, thereby shifting the axial positions of the second roll forming portions for adjusting respective distances between the second roll forming portions and the first roll forming portions.

12. The flange forming apparatus of claim 11 wherein:

the plurality of adjustable roll forming stations are sequentially arrayed along the support frame in a first unitary group; and the apparatus further comprises a plurality of non-concurrently adjustable roll forming stations sequentially arrayed along the support frame in a second unitary group, said adjustable and non-adjustable stations performing sequential operations on the sheet of material for forming a flange therein.

13. The flange forming apparatus of claim 12 wherein:

each roll forming station includes two of said roll forming pairs, a first one of said pairs being located generally above a second one of said pairs, and said first and second pairs being axially aligned and laterally adjacent to one another;

each of said roll forming pairs is a roll forming die, the first and second pairs being complementary in shape to one another for performing a roll forming operation on the sheet of material;

the roll forming pair spindles are attached to and rotatably supported by a fixed bearing block assembly attached to the support frame;

all the second roll forming portions of the roll forming pairs in the sequential array of adjustable roll forming stations are rotatably attached to the bearing support assembly portion of the adjustment linkage assembly, said bearing support assembly including: bearings for rotatably supporting the spindles and second roll forming portions; and one or more bearing blocks holding the bearings, said adjustment linkage assembly extending generally the length of the sequential array of adjustable roll forming stations and being moveable as a unit; and the screw members are threaded through the screw adaptors of the adjustment linkage assembly, wherein rotation of the screw members upon actuation of the adjustment drive unit causes the adjustment linkage assembly to move towards or away from the fixed bearing block assembly and all the second roll forming portions to move away or towards the first roll forming portions.

14. A flange forming apparatus comprising:

a support frame;

a bed positioned atop the support frame, said bed having a width;

a plurality of adjustable roll forming means attached to the support frame along either or both longitudinal sides of said bed for forming a flange in a sheet of material;

first inner and outer head rails disposed along a longitudinal side of said bed;

second inner and outer head rails disposed along another longitudinal side of said bed, said first and said second inner and outer head rails supporting said plurality of adjustable roll forming means;

adjustment means attached to the support frame and operably interfaced with the plurality of adjustable roll forming means for adjusting the roll forming means concurrently together in regards to a dimensional characteristic of the transverse flange to be produced; and a bed-width adjustment mechanism including a first hand wheel positioned along one of said longitudinal side of said bed, first lead screws and a first chain mechanism for connecting the first lead screws to the first hand wheel for adjusting a position of said first inner head rail upon rotation of said first hand wheel to concurrently adjust a position of all of said plurality of roll forming stations supported by said first inner head rail in relation to said second inner head rail, and a second hand wheel positioned along the same longitudinal side of said bed as said first hand wheel, second lead screws and a second chain mechanism for connecting the second lead screws to the second hand wheel for adjusting a position of said second inner head rail upon rotation of said second hand wheel to concurrently adjust a position of all of said plurality of roll forming stations supported by said second inner head rail in relation to said first inner head rail, for adjusting said width of said bed for accommodating different sized sheets of material.

15. A flange forming apparatus comprising:

a support frame;

a bed positioned atop the support frame, said bed having a width;

at least one roll forming station attached to the support frame along either or both longitudinal sides of said bed for at least partially forming a flange in a sheet of material moving through the apparatus, said station comprising first and second rotatable spindles, each of said spindles carrying: a first roll forming portion fixedly attached to the spindle for rotation thereby; and a second roll forming portion attached to the spindle for rotation thereby and coaxial with the first roll forming portion, said second roll forming portion being moveable along the spindle for adjustment of a distance between the first and second roll forming portions, said distance relating to a height of the flange produced by the apparatus;

first inner and outer head rails disposed along a longitudinal side of said bed;

second inner and outer head rails disposed along another longitudinal side of said bed, said first and said second inner and outer head rails supporting said plurality of roll forming stations;

an adjustment mechanism attached to the support frame, said adjustment mechanism rotatably supporting the spindles and establishing, for each spindle, the position of the second roll forming portion along the spindle and thereby the distance between the first and second roll forming portions; and wherein operation of the adjustment mechanism causes the second roll forming portions to concurrently move along their respective spindles, for concurrent adjustment of the distances between the first and second roll forming portions and thereby the height of the flange to be produced by the apparatus a bed-width adjustment mechanism including a first hand wheel positioned along one of said longitudinal side of said bed, first lead screws and a first chain mechanism for connecting the first lead screws to the first hand wheel for adjusting a position of said first inner head rail upon rotation of said first hand wheel to concurrently adjust a position of all of said plurality of roll forming stations supported by said first inner head rail in relation to said second inner head rail, and a second hand wheel positioned along the same longitudinal side of said bed as said first hand wheel, second lead screws and a second chain mechanism for connecting the second lead screws to the second hand wheel for adjusting a position of said second inner head rail upon rotation of said second hand wheel to concurrently adjust a position of all of said plurality of roll forming stations supported by said second inner head rail in relation to said first inner head rail, for adjusting said width of said bed for accommodating different sized sheets of material.

16. The flange forming apparatus of claim 15 wherein:

the spindles are parallel to one another; and the first and second roll forming portions of the first spindle are axially aligned with and laterally spaced apart from the first and second roll forming portions of the second spindle, respectively, said first roll forming portions and said second roll forming portions respectively cooperating for at least partially forming the flange in the sheet of material.

17. The flange forming apparatus of claim 16 wherein the adjustment mechanism includes:

an adjustment drive unit having a motor or hand crank and at least one screw member rotatably driven by said motor or hand crank; and an adjustment linkage assembly having at least one screw adaptor threaded on the at least one screw member, said adjustment linkage assembly rotatably supporting the roll forming station, wherein operation of the adjustment drive unit causes the at least one screw member to rotate and the at least one screw adaptor to move along the at least one screw member, for shifting the adjustment linkage assembly as a whole and thereby adjusting the roll forming station.

18. The flange forming apparatus of claim 17 wherein the adjustment drive unit includes a plurality of screw members, and the adjustment linkage assembly includes a plurality of screw adaptors respectively threaded on the screw members, said screw members being interconnected by a chain drive, wherein rotation of one of the screw members by the motor or hand crank causes all of the screw members to rotate in concert.

19. The flange forming apparatus of claim 18 wherein:

the flange forming apparatus includes a plurality of said roll forming stations; and operation of the adjustment drive unit causes the roll forming stations to be adjusted concurrently, for movement of the second roll forming portions carried on the spindles towards or away from the first roll forming portions.

20. The flange forming apparatus of claim 15 wherein for each spindle, the distance between the first and second roll forming portions is infinitely adjustable within predetermined minimum and maximum limits.

* * * * *